US008651900B1

(12) United States Patent
Hsu

(10) Patent No.: US 8,651,900 B1
(45) Date of Patent: Feb. 18, 2014

(54) CONNECTOR TERMINAL

(71) Applicant: Po-Kai Hsu, New Taipei (TW)

(72) Inventor: Po-Kai Hsu, New Taipei (TW)

( * ) Notice: Subject to any disclaimer, the term of this patent is extended or adjusted under 35 U.S.C. 154(b) by 0 days.

(21) Appl. No.: 13/660,817

(22) Filed: Oct. 25, 2012

(51) Int. Cl.
*H01R 13/24* (2006.01)

(52) U.S. Cl.
USPC ..... 439/700

(58) Field of Classification Search
USPC ..... 439/700, 482, 824; 324/755.05, 762.02
See application file for complete search history.

(56) References Cited

U.S. PATENT DOCUMENTS

| | | | | |
|---|---|---|---|---|
| 7,396,261 | B2 * | 7/2008 | Kroneder et al. | 439/700 |
| 7,476,132 | B2 * | 1/2009 | Xu | 439/700 |
| 7,955,140 | B1 * | 6/2011 | Lin et al. | 439/700 |
| 8,062,078 | B2 * | 11/2011 | Asai et al. | 439/823 |

* cited by examiner

*Primary Examiner* — Phuong Dinh
(74) *Attorney, Agent, or Firm* — Muncy, Geissler, Olds & Lowe, PLLC

(57) ABSTRACT

A connector terminal includes a metal socket defining a top opening and a bottom through hole, a probe head having a lower stoppage portion stoppable inside the metal socket and supported on a spring inside and an upper contact portion extending out of the top opening of the metal socket, and a plug tightly plugged into the bottom through hole of the metal socket.

10 Claims, 8 Drawing Sheets

CONNECTOR TERMINAL

BACKGROUND OF THE INVENTION

1. Field of the Invention

The present invention relates generally to electrical signal connectors and more particularly to a connector terminal, which comprises a metal socket having a metal coating layer coated on inner and outer surface thereof, a probe head, an elastic member floatably supporting the probe head partially in the metal socket and a plug plugged into a bottom through hole of the metal socket, and which has the characteristic of low resistivity (high conductivity) and high level of signal transmission efficiency and stability.

2. Description of the Related Art

With the rapid development of electronic technology and multimedia revolution, cell phone, smart phone, GPS navigation device, PDA and many other mobile electronics are created and widely used in different fields. It is now the market tendency to create mobile devices having light, thin, short and small characteristics. In consequence, electronic components for installation in a circuit board for mobile device must be made smaller, more precise and stronger than ever before.

Further electrical connectors are intensively used to connect electronic devices to a circuit board. An electrical connector generally comprises a plurality of signal connector terminals and power connector terminals connected with respective conductors of a cable for transmitting signal or power supply to a control circuit. As electrical connectors get ever smaller, many new types of electrical connectors are created. For example, a pogo pin connector is a spring loaded connector used in an electronic device to establish a connection between two printed circuit boards. A pogo pin generally comprises a metal socket (cylinder), a probe head mounted in the metal socket, and a spring mounted inside the metal socket to support the probe head. When the probe head is forced toward the inside of the metal socket by an external pressure, the spring can be elastically deformed. Subject to contact between the probe head and the inside wall of the metal socket, the pogo pin achieves electrical connection between two printed circuit boards. For the advantages of small size, large current, strong contact point, high durability and connection stability, pogo pin connectors are widely used in cell phone battery, antenna connectors, GPS navigation device, tablet computer, handheld computer, wireless receiver or wireless communication device for conducting electric current or transmitting signals.

Further, when the probe head of a pogo pin is forced toward the inside of the metal socket to compress the spring, the elastic potential energy of the spring forces the probe head to stop against a part of the inside wall of the metal socket, achieving electric connection. To ensure connection stability, the inner and outer surface of a metal socket for pogo pin will be electroplated with a metal coating layer to enhance conductivity and to provide a better bonding surface. During electroplating, metal ions in a solution are moved by an electric field to coat an electrode. The process uses electrical current to reduce cations of a desired material from a solution and coat a conductive object with a thin layer of the material.

However, as the metal socket of a pogo pin is a blind hole structure, gases (hydrogen and etc.) released during electroplating may be accumulated in the blind hole of the metal socket, causing cracks in the metal coating layer, or affecting even distribution of electric current to lower the speed of the deposition of metal ions on the surface of the metal socket. Due to low current efficiency (the ratio of the amount of electricity, in coulombs, theoretically required to yield a given quantity of material in an electrochemical process, to the amount actually consumed), it takes much plating time to reach the desired coating thickness. Because of slow deposition rate, it is difficult to coat the desired metal coating layer on the inner surface of the metal socket. In consequence, the manufacturing cost of the metal socket is high.

SUMMARY OF THE INVENTION

The present invention has been accomplished under the circumstances in view. It is therefore the main object of the present invention to provide a connector terminal, which has the characteristic of low resistivity (high conductivity) and high level of signal transmission efficiency and stability.

To achieve this and other objects of the present invention, a connector terminal comprises a metal socket comprising a base having a center through hole and a cylindrical body extended from the base, a probe head mounted in the metal socket and partially protruding out of the cylindrical body, an elastic member mounted in the metal socket to floatably support the probe head, and a plug plugged into the through hole of the metal socket. Further, the inner and outer surfaces of the base and cylindrical body of the metal socket are electroplated with a metal coating layer to enhance the mechanical properties of the metal socket. When depositing the metal coating layer on the inner and outer surfaces of the base and cylindrical body of the metal socket, the structural design of the through hole enables the applied electric current to be evenly distributed over the inner and outer surfaces of the metal socket and facilitates quick dissipation of released gases during electroplating. Thus, the finished connector terminal has the characteristic of low resistivity (high conductivity), enhancing signal transmission efficiency and stability.

DETAILED DESCRIPTION OF THE PREFERRED EMBODIMENT

Figure 1:
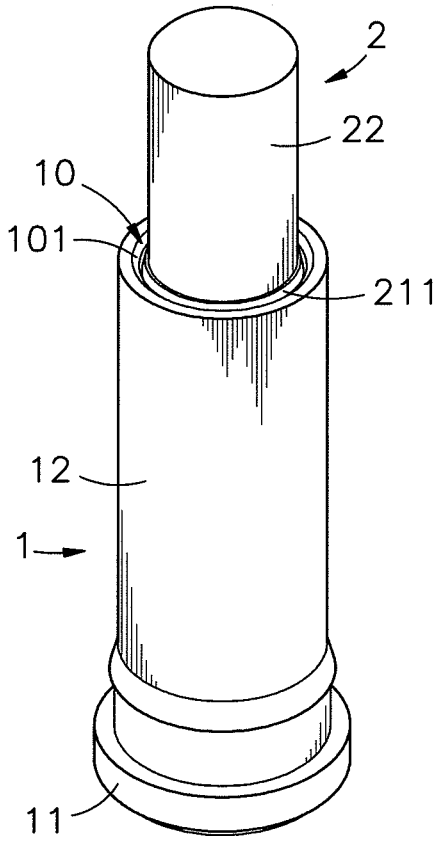
FIG. 1 is an oblique elevational view of a connector terminal in accordance with the present invention.
Figure 2:
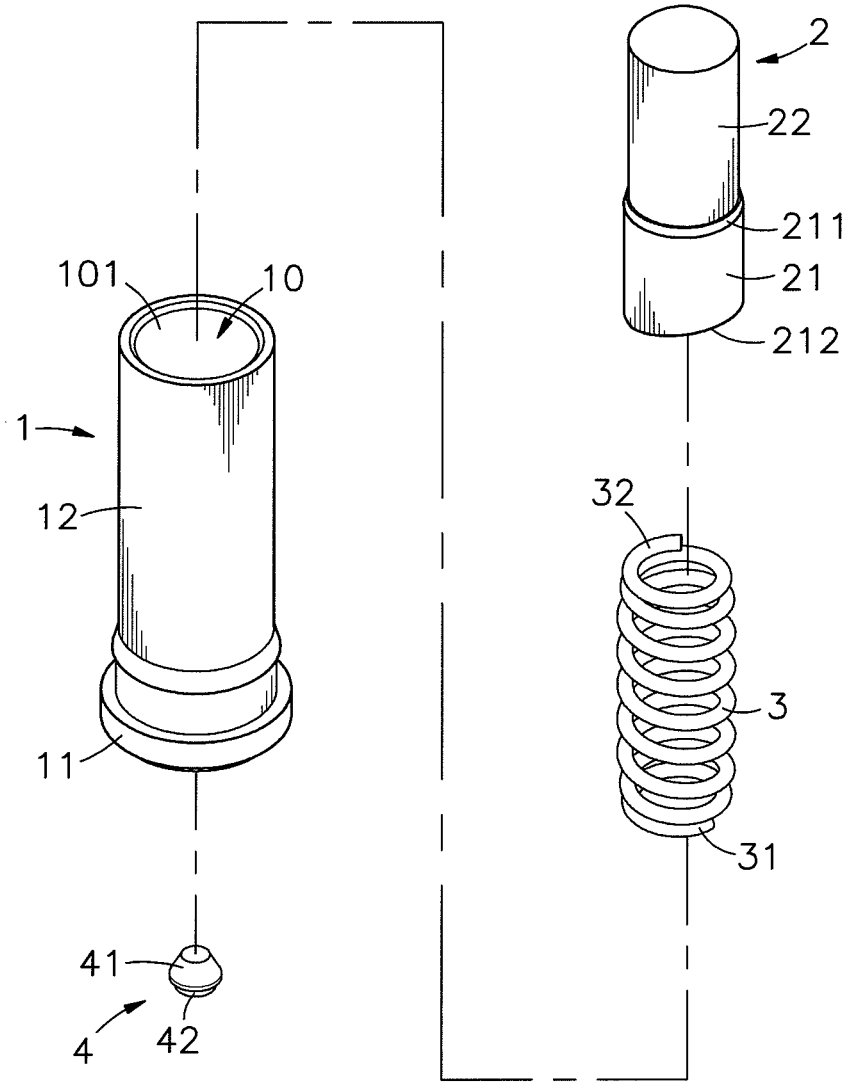
FIG. 2 is an exploded view of the connector terminal in accordance with the present invention.
Figure 3:
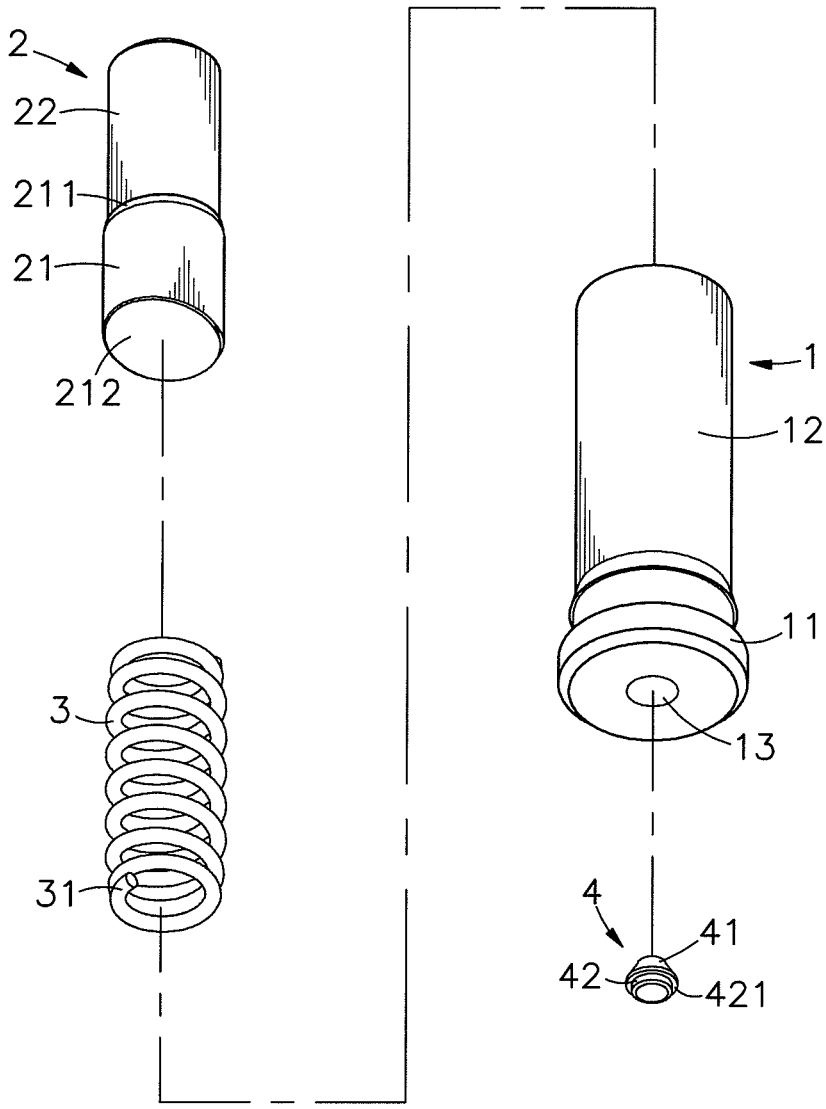
FIG. 3 corresponds to FIG. 2 when viewed from another angle.
Figure 4:
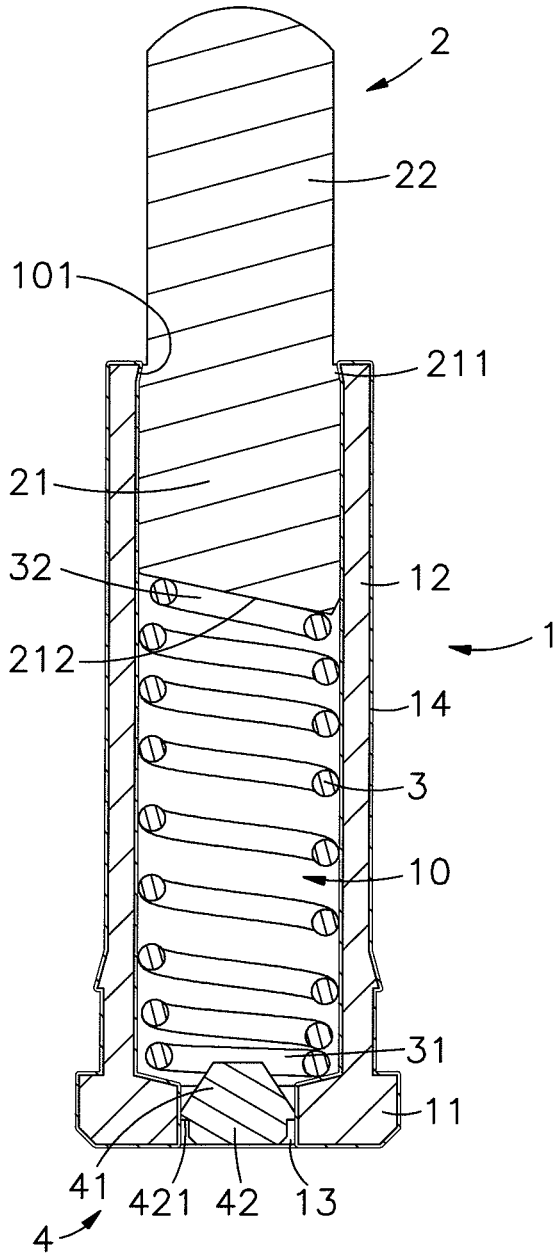
FIG. 4 is a sectional side view of the connector terminal in accordance with the present invention.

Referring to FIGS. 1-4, a connector terminal in accordance with the present invention is shown. The connector terminal comprises a metal socket 1, a probe head 2, an elastic member 3, and a plug 4.

The metal socket 1 comprises a base 11, a cylindrical body 12 perpendicularly extended from one side of the base 11, an accommodation chamber 10 surrounded by the base 11 and the cylindrical body 12 for accommodating the probe head 2 and the elastic member 3, an opening 101 located on one end, namely, the top end of the cylindrical body 12 remote from the base 11 and disposed in communication with the accommodation chamber 10, and a through hole 13 cut through the center of the base 11 in communication with the accommodation chamber 10. The base 11 has an outer diameter equal to or slightly greater than the outer diameter of the cylindrical body 12.

The probe head 2 is shaped like a stepped cylinder, comprising a lower stoppage portion 21 having a relatively larger diameter, an upper contact portion 22 having a relatively smaller diameter, a tapered propping portion 211 connected between the lower stoppage portion 21 and the upper contact portion 22, and a leveled or sloping bottom surface 212 located on the bottom side of the lower stoppage portion 21. Further, the tapered propping portion 211 has an outer diameter gradually reducing in direction from the lower stoppage portion 21 toward the upper contact portion 22.

The elastic member 3 can be a spring, for example, coil spring, having two opposite ends thereof respectively terminating in a first bearing end piece 31 and a second bearing end piece 32.

The plug 4 can be prepared from a flexible material or a rigid material, comprising a conical plug head 41 and a stub plug stem 42 perpendicularly extended from the center of the bottom side of the conical plug head 41. The stub plug stem 42 has a relatively smaller outer diameter than the conical plug head 41 so that an annular space 421 is defined at the bottom side of the conical plug head 41 around the stub plug stem 42.

Figure 5:
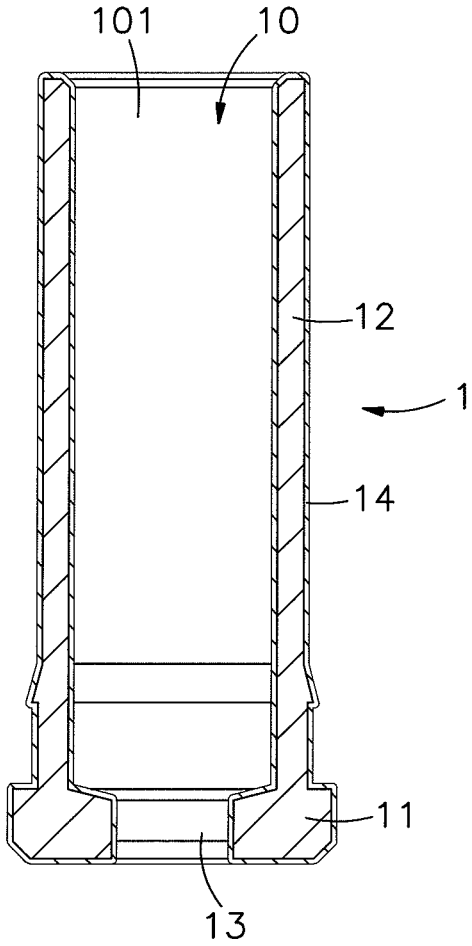
FIG. 5 is a schematic sectional view of the metal socket of the connector terminal in accordance with the present invention, illustrating the distribution of the deposited metal coating layer.
Figure 6:
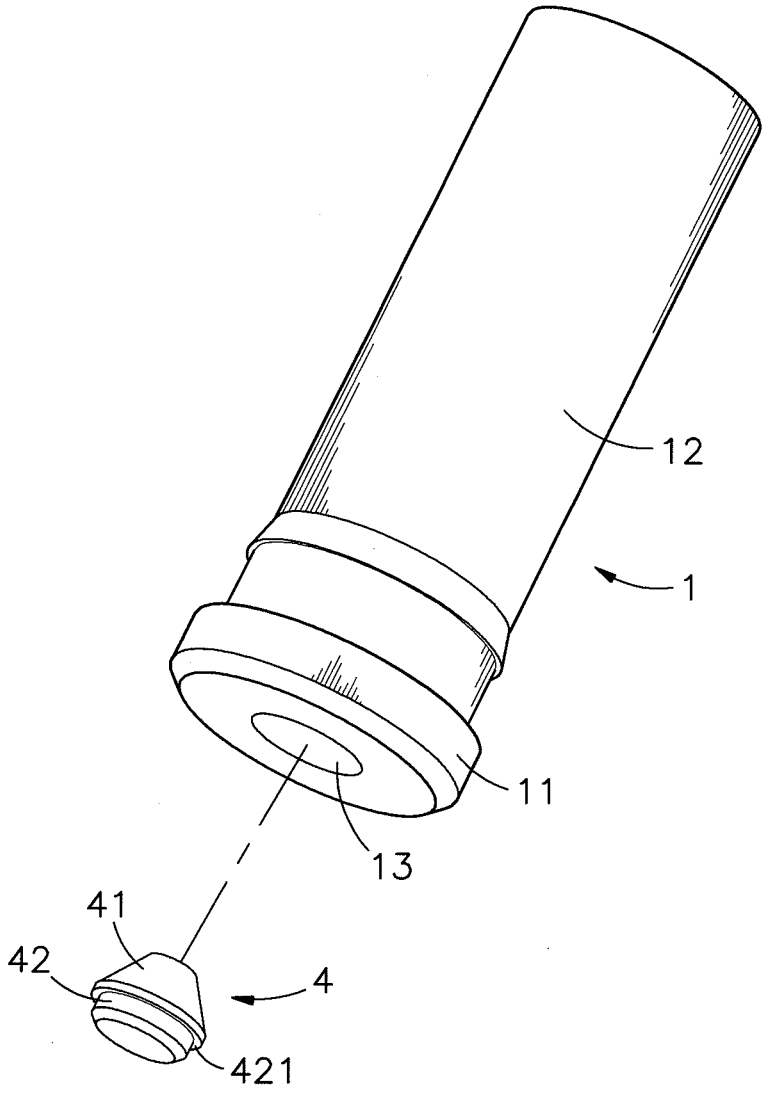
FIG. 6 is an exploded view of a part of the connector terminal in accordance with the present invention, illustrating the relationship between the metal socket and the plug.
Figure 7:
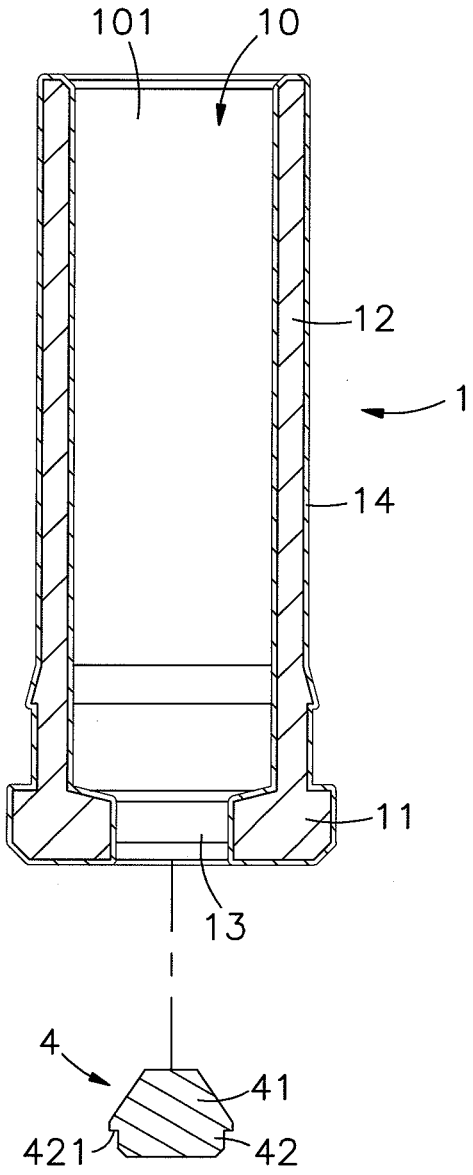
FIG. 7 is a sectional view of FIG. 6.
Figure 8:
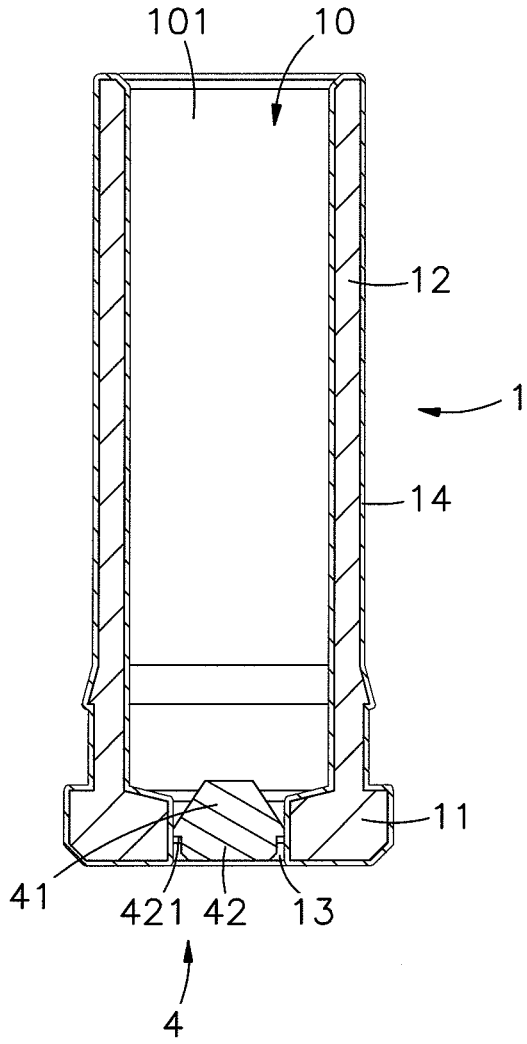
FIG. 8 corresponds to FIG. 7, illustrating the plug plugged into the through hole of the metal socket.

Referring to FIGS. 5-8, the inner and outer surfaces of the base 11 and cylindrical body 12 of the metal socket 1 are electroplated with a metal coating layer 14 to enhance the mechanical properties of the metal socket 1, such as conductivity, thermal resistance, wear resistance and corrosion resistance. Further, the structural design of the through hole 13 enables the applied electric current to be evenly distributed over the inner and outer surfaces of the metal socket 1 and facilitates quick dissipation of released gases during electroplating. Thus, after the metal socket 1, the probe head 2, the elastic member 3 and the plug are assembled, the finished connector terminal has the characteristic of low resistivity (high conductivity), enhancing signal transmission efficiency and stability.

When assembling the metal coating layer-coated metal socket 1 and the plug 4, insert the conical plug head 41 of the plug 4 upwardly into the through hole 13 of the metal socket 1 with force to the state where the bottom edge of the stub plug stem 42 is kept in flush with the bottom wall of the base 11. If the plug 4 is prepared from a flexible material (for example, rubber or silicon rubber), the outer diameter of the conical plug head 41 of the plug 4 must be slightly greater than the diameter of the through hole 13 of the metal socket 1 so that the conical plug head 41 of the plug 4 can be elastically deformed and tightly secured to the through hole 13 of the metal socket 1. If the plug 4 is prepared from a rigid material (for example, rigid plastic material or metal), the outer diameter of the conical plug head 41 of the plug 4 can be equal to or slightly greater than the diameter of the through hole 13 of the metal socket 1 so that the conical plug head 41 of the plug 4 can be tightly secured to the through hole 13 of the metal socket 1 by means of friction.

Referring to FIGS. 2, 4, 5 and 8 again, after installed the plug 4 in the through hole 13 of the metal socket 1, put the probe head 2 and the elastic member 3 in the accommodation chamber 10 of the metal socket 1, then employ a machining technique to reduce the diameter of the opening 101 of the metal socket 1 to the extent where the diameter of the opening 101 is smaller than the lower stoppage portion 21 but larger than the upper contact portion 22. Thus, subject to the elastic potential energy of the elastic member 3, the tapered propping portion 211 of the probe head 2 is forced into friction engagement with the perimeter of the opening 101 of the metal socket 1, preventing the probe head 2 from being forced out of the metal socket 1 accidentally by an external force. Further, the diameter of the through hole 13 of the metal socket 1 is smaller than the outer diameter of the elastic member 3, preventing escape of the elastic member 3. After installation, the first bearing end piece 31 and second bearing end piece 32 of the elastic member 3 are respectively stopped against the base 11 of the metal socket 1 and the bottom surface 212 of the probe head 2, and therefore the elastic member 3 elastically deformably supports the probe head 1 in the metal socket 1.

Multiple pieces of connector terminals constructed in accordance with the present invention can be installed in an electrically insulative substrate (not shown) to form a pogo pin connector for use in a cell phone battery, antenna connector, GPS navigation device, tablet computer, handheld computer, wireless receiver or wireless communication device. After installation of multiple pieces of connector terminals in an electrically insulative substrate, the base 11 of the metal socket 1 of each connector terminal is exposed to the outside of the bottom wall of the electrically insulative substrate, the upper contact portion 22 of the probe head 22 and an upper part of the cylindrical body 12 of the metal socket 1 of each connector terminal around the opening 101 are exposed to the outside of the top wall of the electrically insulative substrate. Thus, the bases 11 of the metal sockets 1 of the connector terminals of the pogo pin connector can then be bonded to a circuit board (not shown). When bonding the base 11 of the metal socket 1 of each connector terminal of the pogo pin connector to the circuit board, the annular space 421 at the bottom side of the conical plug head 41 of the plug 4 around the stub plug stem 42 within the through hole 13 of the metal socket 1 can receive the applied solder paste, presenting insufficient solder coverage and enhancing solder joint strength.

Referring to FIGS. 2, 4, 5 and 8 again, as stated above, a connector terminal in accordance with the present invention comprises a metal socket 1 comprising a base 11 having a center through hole 13 and a cylindrical body 12 extended from the base 11, a probe head 2 mounted in the metal socket 1 and partially protruding out of the cylindrical body 12, an elastic member 3 mounted in the metal socket 1 to floatably support the probe head 2, and a plug 4 plugged into the through hole 13 of the metal socket 1, wherein the inner and outer surfaces of the base 11 and cylindrical body 12 of the metal socket 1 are electroplated with a metal coating layer 14 to enhance the mechanical properties of the metal socket 1. When depositing the metal coating layer 14 on the inner and outer surfaces of the base 11 and cylindrical body 12 of the metal socket 1, the structural design of the through hole 13 enables the applied electric current to be evenly distributed over the inner and outer surfaces of the metal socket 1 and facilitates quick dissipation of released gases during electroplating. Thus, after the metal socket 1, the probe head 2, the elastic member 3 and the plug 4 are assembled, the finished connector terminal has the characteristic of low resistivity (high conductivity), enhancing signal transmission efficiency and stability. Further, the plug 4 can be either solid or hollow, having a cylindrical, conical, round or oval shape.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A connector terminal, comprising:

a metal socket comprising a base, a cylindrical body perpendicularly extended from one side of said base, an accommodation chamber surrounded by said base and said cylindrical body, an opening located on one end of said cylindrical body remote from said base in communication with said accommodation chamber, a through hole cut through the center of said base in communication with said accommodation chamber, and a metal coating layer covering inner and outer surfaces of said base and said cylindrical body;

a probe head comprising a lower stoppage portion suspending inside said accommodation chamber of said metal socket and an upper contact portion extending through said opening to the outside of said metal socket;

an elastic member accommodated in said accommodation chamber of said metal socket, said elastic member comprising a first bearing end piece and an opposing second bearing end piece respectively stopped against said base of said metal socket and said lower stoppage portion of said probe head; and a plug tightly plugged into said through hole of said metal socket.

2. The connector terminal as claimed in claim 1, wherein said through hole of said metal socket has an outer diameter smaller than the outer diameter of said elastic member.

3. The connector terminal as claimed in claim 1, wherein said lower stoppage portion of said probe head has a cylindrical shape; said lower stoppage portion of said probe head defines a flat bottom surface stopped against said second bearing end piece of said elastic member.

4. The connector terminal as claimed in claim 1, wherein said probe head further comprises a tapered propping portion connected between said lower stoppage portion and said upper contact portion, said tapered propping portion having an outer diameter gradually reducing in direction from said lower stoppage portion toward said upper contact portion; said opening of said metal socket has a diameter greater than said upper contact portion of said probe head and smaller than said lower stoppage portion of said probe head.

5. The connector terminal as claimed in claim 1, wherein said upper contact portion of said probe head has an outer diameter smaller than said lower stoppage portion.

6. The connector terminal as claimed in claim 1, wherein said plug comprises a plug head and a stub plug stem perpendicularly extended from the center of a bottom side of said plug head, said stub plug stem having a relatively smaller outer diameter than said conical plug head, said stub plug stem comprising a bottom edge kept in flush with a bottom wall of said of said metal socket.

7. The connector terminal as claimed in claim 6, wherein said plug head of said plug has a conical shape.

8. The connector terminal as claimed in claim 6, wherein said plug defines an annular space at a bottom side of said plug head around said stub plug stem within said through hole of said metal socket.

9. The connector terminal as claimed in claim 1, wherein said plug is a flexible member prepared from material selected from rubber or silicon rubber; said plug head of said plug has an outer diameter greater than the diameter of said through hole of said metal socket.

10. The connector terminal as claimed in claim 1, wherein said plug is a rigid member prepared from material selected from rigid plastics or metal; said plug head of said plug has an outer diameter equal to or greater than the diameter of said through hole of said metal socket.

* * * * *